United States Patent [19]

Campbell

[11] Patent Number: 5,037,335

[45] Date of Patent: Aug. 6, 1991

[54] BATTERY JUMPER CABLE CONNECTOR

[76] Inventor: Delmer E. Campbell, 1903 South Ave., Springfield, Mo. 65807

[21] Appl. No.: 510,144

[22] Filed: Apr. 17, 1990

[51] Int. Cl.[5] ..... H01R 11/12; H01R 11/26

[52] U.S. Cl. ..... 439/755; 439/217; 439/859

[58] Field of Search ..... 439/754–774, 439/859, 822, 829, 217

[56] References Cited

U.S. PATENT DOCUMENTS

| | | | |
|---|---|---|---|
| 1,130,162 | 3/1915 | Hale | 439/859 |
| 2,012,770 | 8/1935 | Quintavalle | 439/859 |
| 4,174,879 | 11/1979 | Suverision | 439/859 |
| 4,620,767 | 11/1986 | Woolf | 439/755 |
| 4,913,668 | 4/1990 | Chamberlain | 439/755 |

*Primary Examiner*—Neil Abrams

*Attorney, Agent, or Firm*—D. A. N. Chase

[57] ABSTRACT

An electrical connector is designed for use in attaching electrical cables to side mounted battery terminals which utilize a threaded bolt to secure the vehicle battery cables to the terminal. One embodiment of the connector comprises an elongated housing presenting a longitudinal slot to receive the battery cable securing bolt. Longitudinal movement of the housing permits flanges to become engaged with the bolt and direct the bolt into an operative position whereby the bolt is contacted by conductive means within the connector housing. The connector housing may either be permanently affixed to a current carrying cable or alternatively may have the spring clamp jaws of a battery jumper cable set applied to the exterior of the housing for transfer of current. Alternative embodiments are also disclosed.

2 Claims, 5 Drawing Sheets

Fig. 17
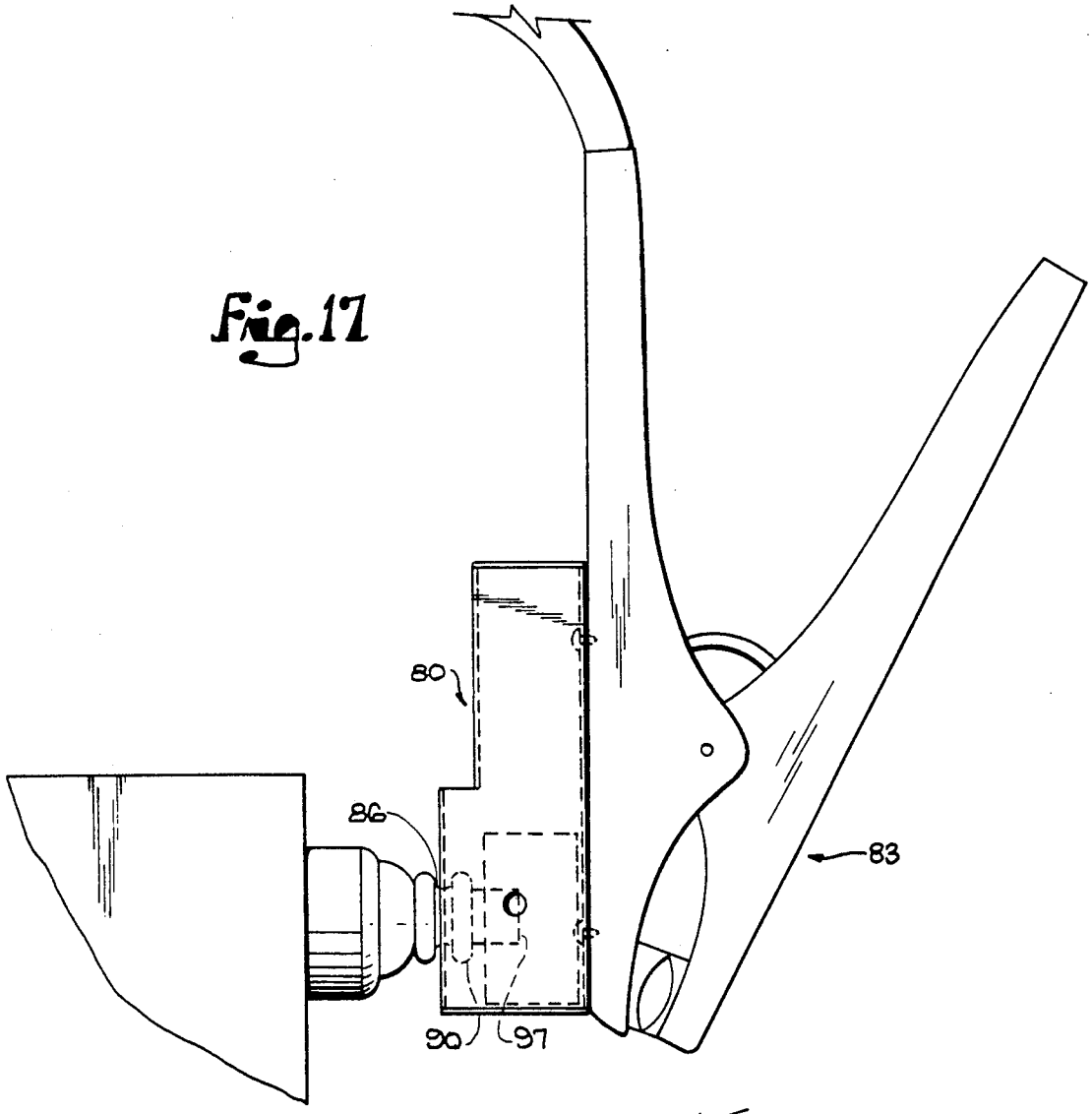
Fig. 18
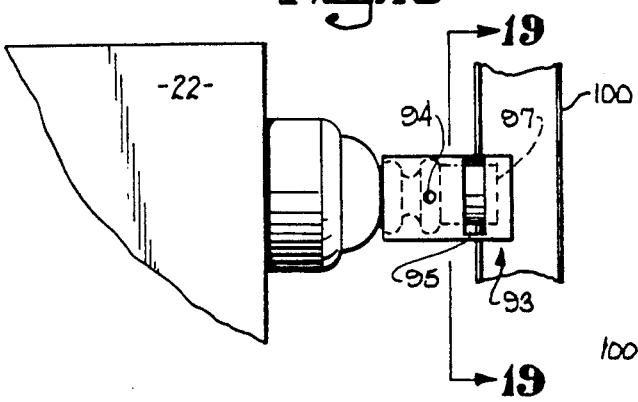
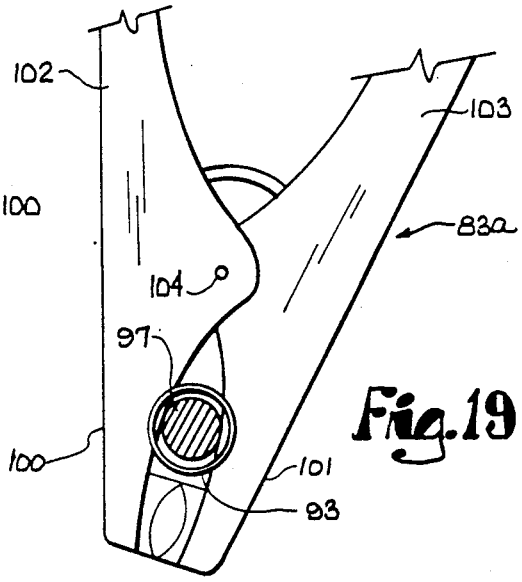
Fig. 19

BATTERY JUMPER CABLE CONNECTOR

BACKGROUND OF THE INVENTION

This invention relates to an apparatus for connecting an electrically conductive cable to a battery having positive or negative terminals mounted on the side of the battery. More particularly this invention relates to a connector adapted to engage the side mounted battery terminal connecting bolt and thereby provide a secure electrically conductive connection between the battery terminal and a current carrying cable for transfer of electrical current to a weak or discharged battery.

Side-mounted battery terminals have long been known in the art and are characterized by the positive and negative posts of the battery being presented on the side of the battery casing rather than the top of the casing. The terminals of side-mounted batteries generally incorporate a void, threaded to receive a bolt, by which the battery cables are connected to the side mounted terminal. When the battery must be recharged or external power applied to the battery, connecting jumper cables is difficult as only the head of the bolt securing the battery cable is available for application of the jumper cable.

Conventional spring-jaw type battery jumper cable connectors are best suited for connection to lead top-mounted post-type battery terminals. Top-mounted lead terminal posts offer greater surface area for the jaw-type jumper cable connectors to grasp. When such jaw-type jumper cable connectors are applied to the hard steel securing bolt of a side-post-type battery terminal, the cable connectors will slip from the side terminal cable securing bolt thus interrupting proper connection.

The inability of jaw-type jumper cable clamps to properly grasp side post terminals is due to two factors of construction in side-post battery terminals. First, the securing bolt used in side-mounted battery terminals is generally composed of much harder material than the lead used in top mounted post-type battery terminals. Steel is commonly used to manufacture the side post terminal bolts and its greater hardness prevents the jaw-type jumper cable clamp connectors from tightly grasping the side terminal securing bolt. The second factor is presented in the location of side terminal batteries within the engine compartment. Frequently side mount batteries are located closely adjacent to other portions of the engine compartment or engine itself. This positioning of the battery substantially reduces the access space to the battery terminals and increases the difficulty in achieving successful contact of the battery jumper cables to the side-post terminal bolt heads.

It is therefore an object of the present invention to provide a jumper cable connector for side terminal batteries which requires little space adjacent to the battery terminal for secure and convenient connection to the battery terminal.

An additional objective of the invention is to provide a connector for side-mounted battery terminals which can securely be attached to the limited electrically conductive surface presented by side-mounted battery terminals.

A further objective of the present invention is to provide a battery jumper cable connector which may be conveniently and rapidly secured to the bolt head securing the battery cable to the side-mounted battery terminal.

Other objectives and advantages of this invention will become apparent from the following description taken in connection with the accompanying drawings, wherein are embodiments of this invention set forth by way of illustration and example.

BRIEF DESCRIPTION OF THE DRAWINGS

The foregoing objects and other features and advantages of this invention will be apparent to those skilled in the art from the following detailed description taken in conjunction with the accompanying drawings in which:

FIG. 17 is a side elevation of the embodiment of FIG. 12, as attached to a battery jumper cable clamp and shown in position on a battery cable terminal;

FIG. 18 is a side elevation of yet another embodiment of the invention showing by phantom lines the battery cable securing bolt.

FIG. 19 is a vertical sectional view taken along sleeve and securing bolt by the jaws of standard battery jumper cables and connection of the sleeve to the jaw.

DETAILED DESCRIPTION

Figure 1:
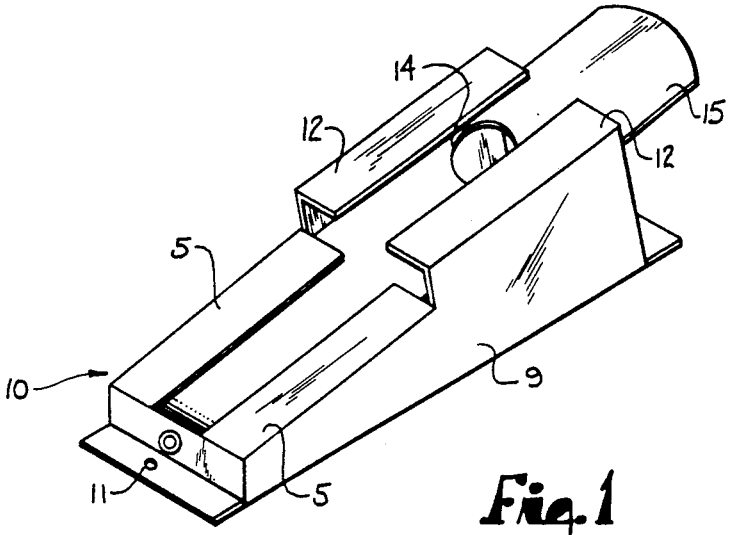
FIG. 1 is a perspective view of one embodiment of the invention.
Figure 2:
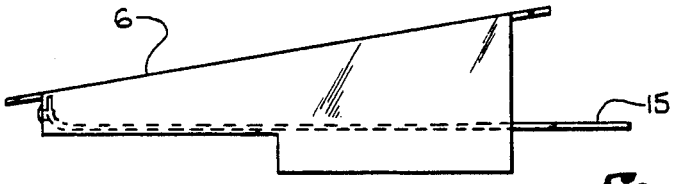
FIG. 2 is a side elevation of the embodiment of FIG. 1.
Figure 3:
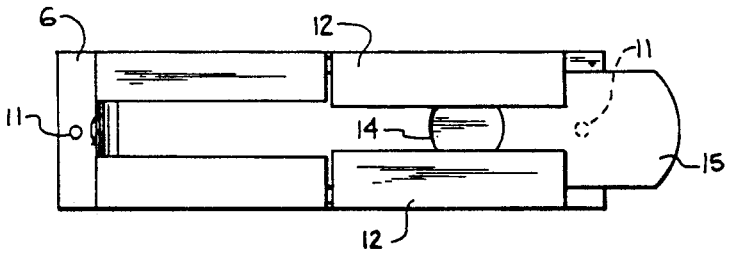
FIG. 3 is a plan view of the embodiment of FIG. 1.

Reference is first made to FIG. 1 showing a perspective view of one embodiment of the invention. A connector 10 for a side mounted battery terminal is shown in the form of an elongated housing 9 presenting a two step longitudinal slot formed by guide 5 and flanges 12. The first step is guide 5 which initially receives a battery cable securing bolt and thereby aligns the grooves 18 (FIG. 4) of the bolt 20 for frictional fit with housing flanges 12 (FIG. 1). The housing base 6 (FIG. 3) has mounting holes 11 to permit the connector to be attached to a jaw-type battery jumper cable clamp as shown in FIG. 17 for an alternative housing 80 to be subsequently described. Alternatively jaw-type battery jumper cables may be clamped onto the housing itself.

Figure 4:
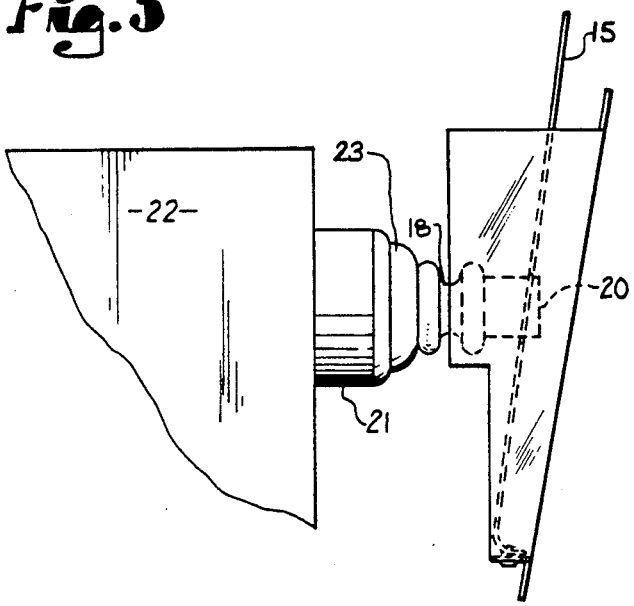
FIG. 4 is a side elevation view of the embodiment of FIG. 1, showing the cable connector in contact with the battery cable securing bolt head.

FIG. 4 shows the side mounted terminal 21 of a battery 22 to which is attached a vehicle electrical cable terminus 23 with the cabling removed for clarity. To attach the battery jumper cables equipped with the invention to a side terminal 21 of a battery 22 the battery terminal cable securing bolt head 20 of FIG. 4 may be pressed against the spring flange 15 of the connector permitting the connector housing to be moved such that housing flanges 12 are brought into substantial contact with the grooves 18 found on the cable securing bolt of side mount battery terminals to permit the cable securing bolt head 20 to be received by the bolt head void 14 of spring flange 15.

Once the charging of the battery or other operation has been completed, the battery cable connector may be removed by depressing spring flange 15 so as to release the bolt head 20 from capture in void 14, followed by shifting the body of the connector so as to release the grooves from the contact with housing flanges 12.

Figure 5:
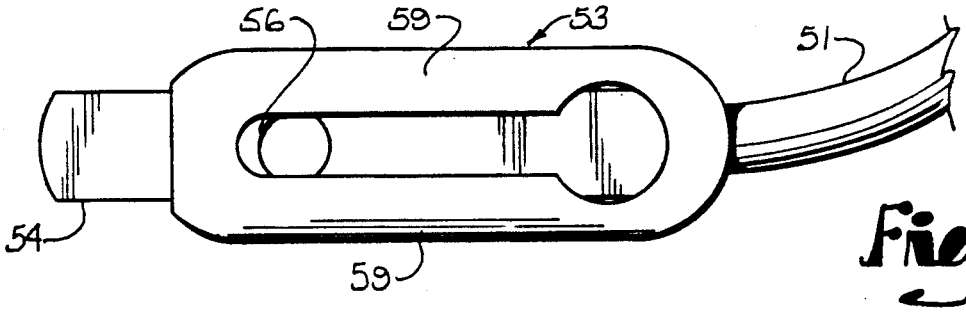
FIG. 5 is a plan view of a second embodiment of the invention.

Reference is made to FIG. 5 showing a plan view of an alternative embodiment of the invention. In this embodiment, an electrically conductive cable 51 is attached to the housing 53 so that the entire housing 53 as well as spring flange 54 conduct the current to the battery terminal.

Figure 6:
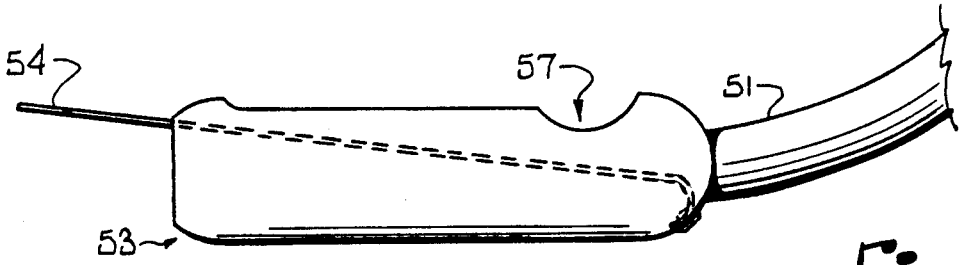
FIG. 6 is a side elevation of the embodiment of FIG. 5.

FIG. 6 shows the placement of spring flange 54 within the housing 53. The spring flange is placed therein such that as the bolt head is placed into entry area 57 the connector may be positioned to capture the bolt head 58 (FIG. 7) within void 56 (FIG. 5) contained in spring flange 54 and to permit housing flanges 59 (FIG. 5) to engage the grooves 60 (FIG. 7) of the securing bolt.

Figure 7:
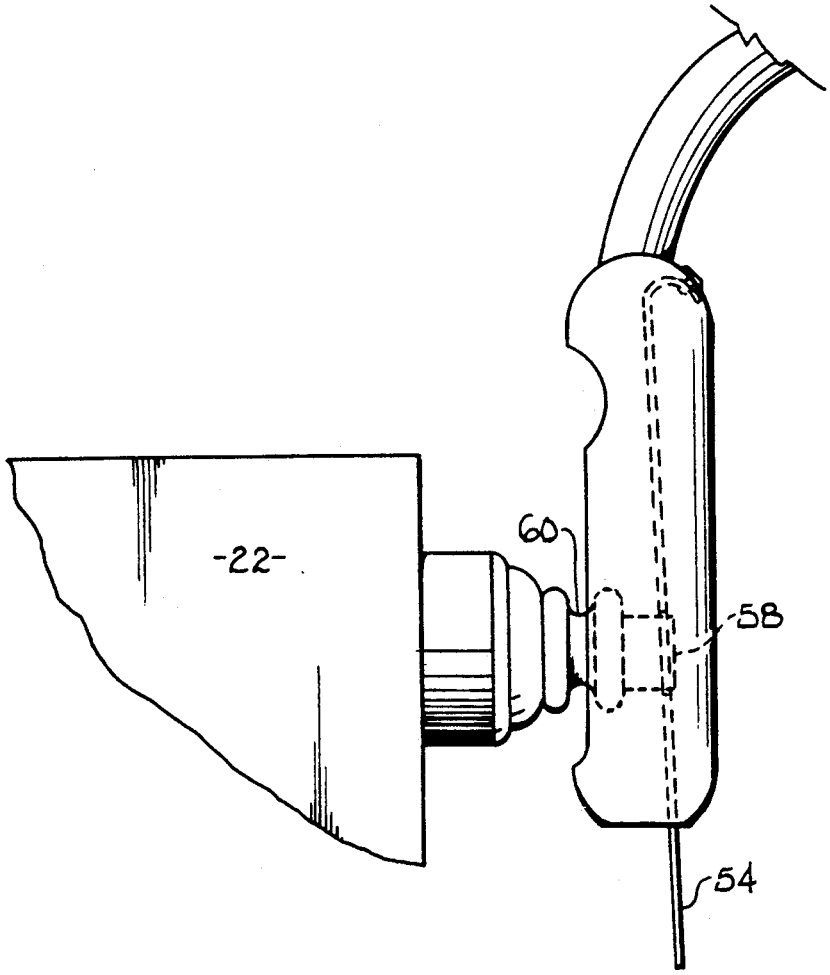
FIG. 7 is a side elevation of the embodiment of FIG. 5, illustrating the bolt head of the battery cable in relative position with the battery terminal securing bolt.
Figure 8:
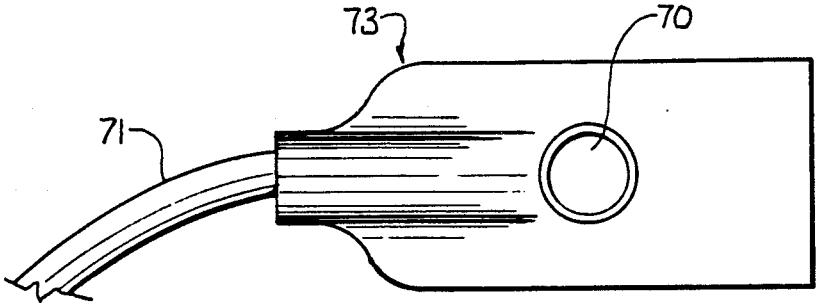
FIG. 8 is a plan view of another embodiment of the invention.
Figure 9:
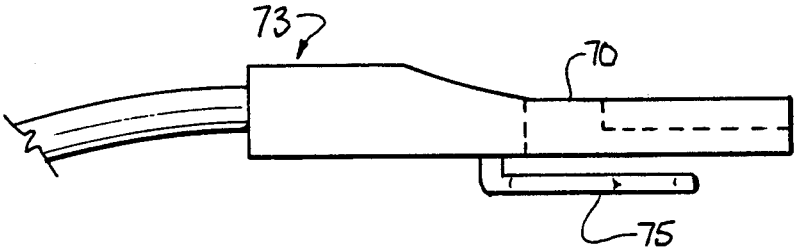
FIG. 9 is a side elevation of the embodiment of FIG. 8.

In FIG. 7 the invention is shown secured to a battery cable terminal. Removal of the invention from the battery terminal is accomplished by depressing spring flange 54 so as to release the securing bolt head 58 from capture by spring flange void 56 (FIG. 5) and thereupon the entire invention may be moved to position the securing bolt within entry area 57 to accomplish removal of the invention.

Figure 10:
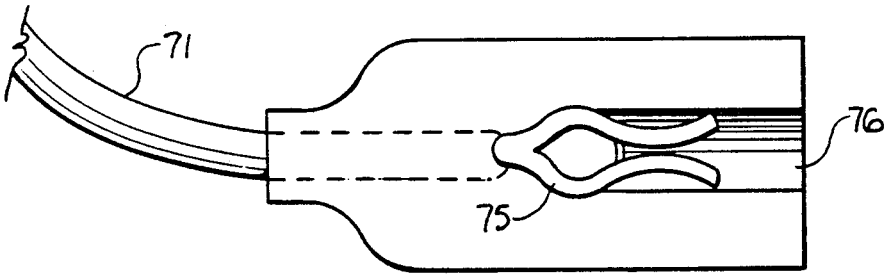
FIG. 10 is a plan view of the obverse of FIG. 8.
Figure 11:
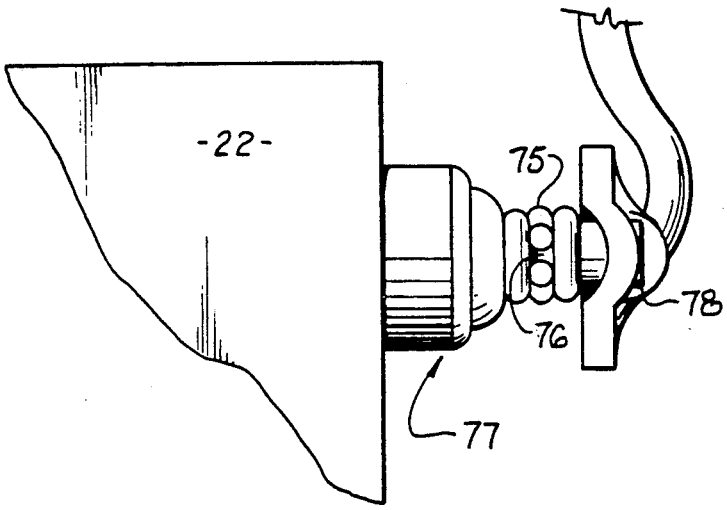
FIG. 11 shows the embodiment of FIG. 8, as it is applied to a battery cable terminal.

Referring now to FIGS. 8–11, an alternative embodiment of the present invention is illustrated. The housing 73 shown in FIG. 8 may be made of conductive material or it may be made of an insulator and the electric current conducted to the battery terminal by direct contact of the electrically conductive cable 71 with the opposing arms 75 as shown in FIG. 10. FIG. 11 demonstrates the connection of this embodiment of the invention with a battery terminal 77. In this embodiment the opposing arms 75 are frictionally connected with the groove 76 of the securing bolt and the bolt head 78 is received by aperture 70 in housing 73 by passing along a concave groove 76 in the housing 73. The embodiment of FIGS. 8–11 is released from contact with the battery terminal securing bolt by pulling on housing 73 to release the bolt head 78 from aperture 70 and exerting lateral pressure so as to overcome the frictional grip of opposing arms 75.

Figure 12:
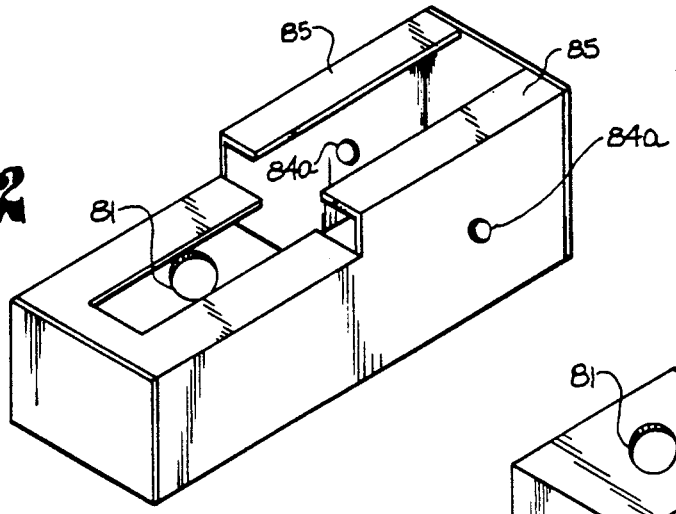
FIG. 12 is a perspective view of another embodiment of the invention.
Figure 13:
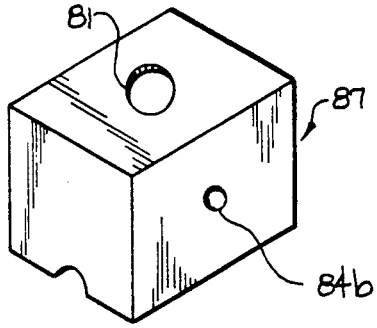
FIG. 13 is a perspective view of the interior sliding cradle of FIG. 12.

Reference is now made to FIGS. 12–17 illustrating yet another alternative embodiment of the present invention. In this embodiment a conductive cradle 87 (FIG. 13) having a void 81 located in its top surface is slidably mounted within housing 80 (FIG. 12). In operation the battery terminal bolt head is positioned within void 81 and housing 80 is moved such that flanges 85 frictionally secure the housing to the grooves 76 (FIG. 11) of a battery terminal securing bolt. In FIG. 12 concave depressions **84*a* on either side of housing 80 fit into complimentary depressions 84*b* on cradle 87 and serve to lock the cradle 87 and maintain the position of the cradle with respect to the housing flanges 85** as the invention is fit to the battery terminal.

Figure 14:
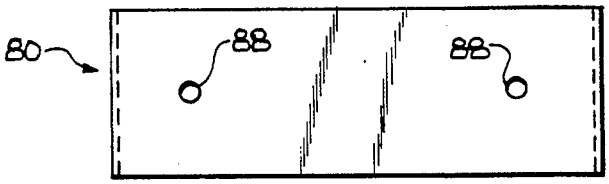
FIG. 14 is a bottom view of FIG. 12 showing the voids used for attachment of the invention to standard battery cable clamps.
Figure 15:
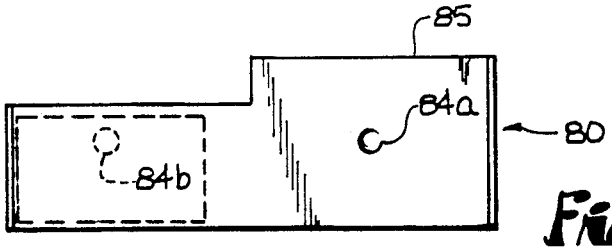
FIG. 15 is a side view of FIG. 12 with phantom lines showing the interior cradle of FIG. 13 within the exterior housing of FIG. 12.
Figure 16:
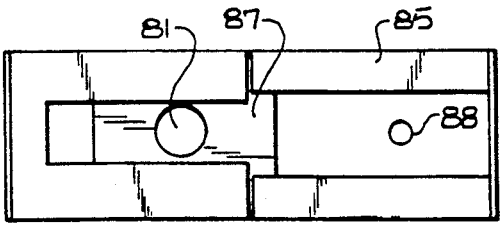
FIG. 16 is a plan view of FIG. 12, showing the interior cradle and interior cradle void for receiving the bolt head of a side mounted battery terminal securing bolt.

FIG. 14 illustrates voids 88 in the base of housing 80 through which may pass a screw or bolt or rivet for securing housing 80 to the side of the conductive jaws of any readily available jumper cable as shown in FIG. 17. FIG. 15 illustrates the initial position of the cradle 87 within housing 80. It is in this position that the cradle 87 is prepared to receive the battery terminal bolt head. Upon inserting the bolt head 97 (FIG. 17) into void 81 the cradle may be moved within the housing 80 such that the securing bolt grooves 86 (FIG. 17) are engaged by housing flanges 85 (FIG. 12). The cradle 87 is then held in place by engagement of depressions **84*a* and 84*b* in housing 80 and cradle 87** respectively.

It is to be understood that once the connector is in place standard jaw-type jumper cables may be conveniently clamped to the housing. Alternatively the housing may have an electrically conductive cable attached to its exterior or the housing itself may be affixed to the exterior of standard jaw-type jumper cables.

Referring to FIG. 17 the embodiment of FIGS. 12–16 is shown attached to a set of conventional battery jumper cables 83 and placed in position over a battery cable terminal securing bolt 90. When the invention is in connection with the battery terminal as illustrated in FIG. 17 it may be removed by shifting the housing 80 in such a fashion so as to release the battery terminal from frictional contact with flanges 85 (FIG. 12) to permit release of the battery terminal bolt head from void 81.

A further embodiment of the present invention is shown in FIG. 18. In this embodiment of the invention a cylindrically shaped sleeve 93 is adapted to slidably engage a battery cable securing bolt 97 and is held in place by a friction fit between the battery cable securing bolt and depressions 94 formed in the sleeve which present internal protuberances for frictionally gripping the outer annular enlargement 91 on the bolt 97. When the sleeve is in place on the cable securing bolt 97, transverse slots 95 on opposing sides of the sleeve permit contact of both the conductive sleeve 93 and the cable securing bolt 97 by the jaws 100 and 101 of a standard jaw-type jumper cable clamp **83*a***. It should be understood that if desired the sleeve can be of any cylindrical form complemental to the terminal and may have a longitudinal slot to impart a transversely "C" shaped configuration to the sleeve.

Referring to FIG. 19 the attachment of the jaws 100 and 101 of the jumper cable clamp **83*a* is shown. The jumper cable handles 102 and 103 are pivotally joined at a pivot axis 104 to permit the jaws 100 and 101 to be opened and closed. The longitudinal axis of sleeve 93 is oriented parallel to the pivot axis 104. The contact sleeve 93 is positioned within jaws 100 and 101 such that the interior edges of the jaws may be received within the transverse slots 95 of sleeve 93 (FIG. 18) to grip the battery cable securing bolt 97 as well as sleeve 93 to provide electrical contact between battery 22 and the jumper cables (not shown) extending from clamp 83***a*

This embodiment of the invention is a more compact connector. Sleeve 93 may be a separate piece or alternatively it may be permanently mounted on the jumper cable clamp 83*a*. When permanently attached to the jumper cables the clearance slots 95 permit the jaws 100 and 101 to fully close such that the use of the jumper cables with top mounted terminals is not impeded. When the sleeve is attached to either of jaws 100 or 101 one of transverse slots 95 of sleeve 93 is fitted into the edge of either of jaws 100 or 101 and the sleeve permanently affixed to the jaw such that the pivot axis 104 and the longitudinal axis of sleeve 93 are substantially parallel.

When the sleeve is attached in this fashion to one of the jaws, the opposing jaw is permitted to move in and out of the transverse slot 95 adjacent to it. In this manner the jumper cable clamp 83*a* may be removably attached to a side post battery terminal by spreading the opposing jaws, aligning the contact sleeve 93 with the battery cable securing bolt 97 and laterally displacing the jumper cable clamp 83*a* so that the sleeve is fitted over the securing bolt 97. The opposing jaws 100 and 101 are then allowed to close such that the unattached jaw is received in the transverse slot 95 adjacent to it and capture of the battery cable securing bolt 97 and the contact sleeve 93 by the jaws 100 and 101 is accomplished.

It is to be understood that while certain forms of this invention have been illustrated and described, the invention is not limited thereto except insofar as such limitations are included in the following claims.

Having thus described the invention, what is claimed as new and desired to be secured by Letters Patent is:

1. A connector for attachment to a battery, said battery having at least one terminal mounted on the side of the battery and having a battery cable securing bolt, said connector comprising:

a jaw-type jumper cable clamp having a pair of handle members each provided with an end portion presenting a jaw, and pivot means mounting said members for movement of the jaw portions thereof toward and away from each other about a predetermined axis;

a contact sleeve having a longitudinal axis and adapted to receive said battery cable securing bolt; and means conductively securing said sleeve to said clamp between said pivot means and the jaw portions thereof with the axes of the pivot means and the sleeve in substantial parallelism, whereby said bolt may be captured by the sleeve and electrical contact made therewith by positioning the connector alongside the battery and displacing it laterally toward the battery with the axis of the sleeve aligned with the bolt.

2. The connector as claimed in claim 1, wherein said contact sleeve has clearance means for receiving said members to permit said jaws to close.

* * * * *